United States Patent [19]

Tighe, Jr.

[11] Patent Number: 4,596,432

[45] Date of Patent: Jun. 24, 1986

[54] SHIELDED RIBBON COAX CABLE ASSEMBLY

[75] Inventor: Charles I. Tighe, Jr., Hershey, Pa.

[73] Assignee: AMP Incorporated, Harrisburg, Pa.

[21] Appl. No.: 577,318

[22] Filed: Feb. 7, 1984

Related U.S. Application Data

[63] Continuation of Ser. No. 323,164, Nov. 20, 1981, abandoned.

[51] Int. Cl.[4] ..... H01R 13/58

[52] U.S. Cl. ..... 339/107; 339/176 MF; 339/177 R; 339/138

[58] Field of Search ..... 339/136, 138, 140, 141, 339/177, 14 R, 143, 147, 103, 107, 97 R, 198 G, 99 R, 97 P, 176 MF; 29/858, 859, 631; 156/47, 48, 49, 295; 174/76, 77, 35 C

[56] References Cited

U.S. PATENT DOCUMENTS

| | | | |
|---|---|---|---|
| 3,617,614 | 11/1971 | Henry | 174/77 R |
| 3,707,696 | 12/1972 | Carter | 339/103 M |
| 3,755,615 | 8/1973 | Paullus et al. | 174/76 |
| 3,823,254 | 7/1974 | Smith | 174/92 |
| 3,951,506 | 4/1976 | Bennett et al. | 339/104 |
| 3,963,319 | 6/1976 | Schumacher et al. | 339/176 MF |
| 3,999,830 | 12/1976 | Herrmann, Jr. et al. | 339/141 |
| 4,066,321 | 1/1978 | Villazon | 339/98 |
| 4,138,184 | 2/1979 | Knopp | 339/97 P |
| 4,272,148 | 6/1981 | Knach, Jr. | 339/141 |
| 4,343,528 | 8/1982 | Lucius et al. | 339/198 G |
| 4,398,780 | 8/1983 | Noventy et al. | 339/138 |
| 4,406,510 | 9/1983 | Debortoli et al. | 339/103 M |
| 4,449,778 | 5/1984 | Lane | 339/107 |

*Primary Examiner*—Gil Weidenfeld

*Assistant Examiner*—David L. Pirlot

*Attorney, Agent, or Firm*—Adrian J. LaRue

[57] ABSTRACT

A ribbon coax cable termination comprises a ribbon coax cable including a plurality of center conductors with each center conductor surrounded by dielectric sheathing, drain conductors extending along each dielectric sheathing, metal foil encircling each dielectric sheathing and drain conductor associated therewith thereby defining coaxial conductor members and a dielectric jacket covering the coaxial conductor members and maintaining them insulated from each other and coplanar. Electrical connectors include insulating housing having electrical contacts therein which contain conductor-receiving sections in which exposed ends of the center conductors and the drain conductors are electrically connected. Elastomeric material extends along the section of the insulating housing containing the conductor-receiving sections and covering the conductor-receiving sections with the exposed ends of the center and drain conductors therein and an adjacent section of the ribbon coax cable. Cover members are secured to the insulating housing along the elastomeric material and to each other, the elastomeric material absorbing stresses to the cable to maintain the center conductors and drain conductors of the cable at the connections with the conductor-receiving sections in position. According to another aspect of the present invention, the ribbon coax cable is in pairs which are encased in a protective sheath including braided-metal strain member having a dielectric jacket thereover, the ends of the protective sheath being secured in metal housing members that are secured onto the connector housing.

11 Claims, 8 Drawing Figures

SHIELDED RIBBON COAX CABLE ASSEMBLY

This application is a Continuation of application Ser. No. 323,164 filed Nov. 20, 1981, now abandoned.

FIELD OF THE INVENTION

This invention relates to ribbon coaxial cable and more particularly to a ribbon coaxial cable assembly including connectors terminating the ends thereof, elastomeric material extending along the ends of the cables and center and drain conductor terminations to maintain the integrity of the termination, and insulated braided armor sheathing protecting the terminated cable and providing shielding thereof.

BACKGROUND OF THE INVENTION

U.S. Pat. No. 3,775,552 discloses ribbon coaxial cable and U.S. Pat. No. 4,040,704 discloses typical connectors for terminating the conductors of the cable thereby forming ribbon coaxial assemblies for use by electronic systems for interconnecting electric circuits thereof. The use of such a terminating arrangement has proven to be successful so long as the terminated cable has not been subjected to twist and bend stresses.

In many cases, terminated ribbon coax cable assemblies are used to electrically connect electronic equipment together. These cable assemblies are bent and twisted thereby subjecting them to stresses which cause the internal elements of the ribbon coaxial cable to move relative to each other which can result in failure of the terminations. Moreover, after a length of cable has been removed from a roll of the cable and its ends have been terminated in electrical connectors, the cable undergoes stress relaxation whereby the internal elements of the cable move relative to each other which places stresses on the cable and its terminations which can result in failure.

According to the present invention, a ribbon coax cable termination comprises a ribbon coax cable including a plurality of center conductors with each center conductor surrounded by dielectric sheathing, drain conductors extending along each dielectric sheathing, metal foil encircling each dielectric sheathing and drain conductor associated therewith thereby defining coaxial conductor members and a dielectric jacket covering the coaxial conductor members and maintaining them insulated from each other and coplanar. Electrical connectors include insulating housing having electrical contacts therein which contain conductor-receiving sections in which exposed ends of the center conductors and the drain conductors are electrically connected. Elastomeric material extends along the section of the insulating housing containing the conductor-receiving sections and covering the conductor-receiving sections with the exposed ends of the center and drain conductors therein and an adjacent section of the ribbon coax cable. Cover members are secured to the insulating housing along the elastomeric material and to each other, the elastomeric material absorbing stresses to the cable to maintain the center conductors and drain conductors of the cable at the connections with the conductor-receiving sections in position.

According to another aspect of the present invention, the ribbon coax cable is in pairs which are encased in a protective sheath including braided-metal strain member having a dielectric jacket thereover, the ends of the protective sheath being secured in metal housing members that are secured onto the connector housing.

According to a further aspect of the present invention, a method of terminating an end of a ribbon coax cable comprises the steps of connecting stripped center conductors and drain conductors to conductor-receiving sections of electrical contacts disposed in an insulating housing; applying an elastomeric material to the conductor-receiving sections, stripped center and drain conductors and a section of the ribbon coax cable; and securing cover members to the housing, over the elastomeric material and together.

DETAILED DESCRIPTION OF THE PREFERRED EMBODIMENT

Figure 1:
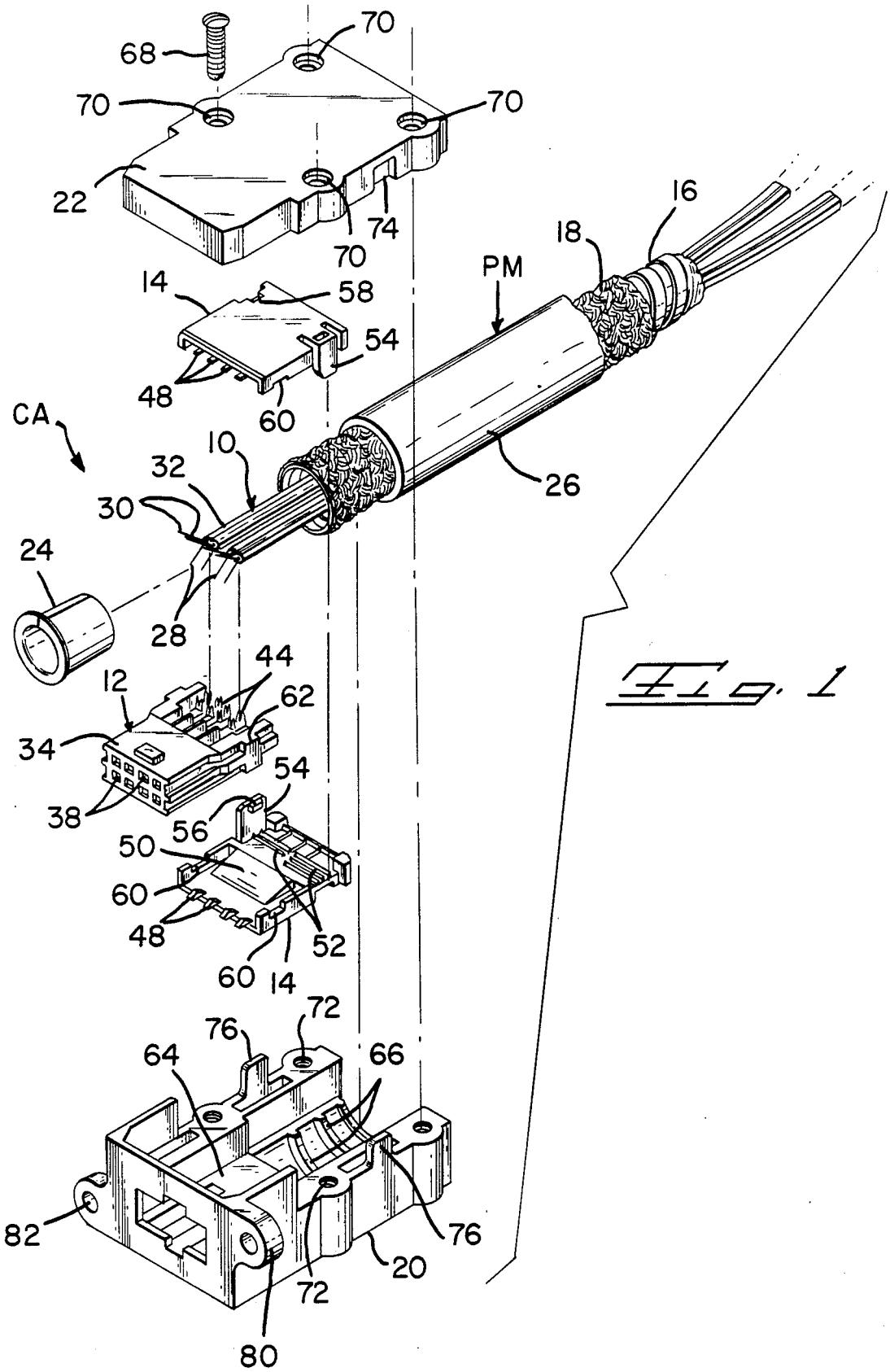
FIG. 1 is an exploded perspective view of a ribbon coax cable assembly with parts of the protective sheath broken away.
Figure 2:
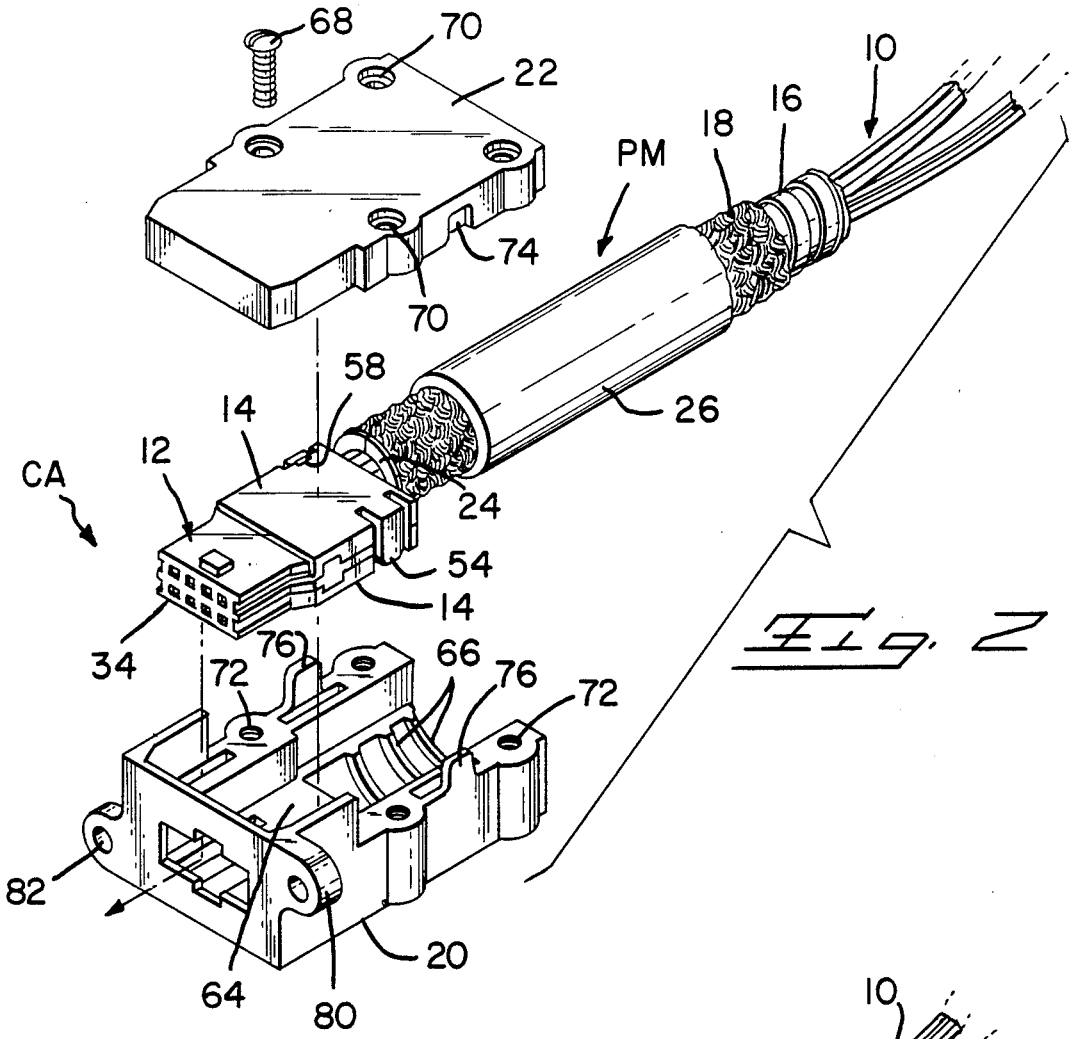
FIG. 2 shows a view similar to FIG. 1 with the cable assembly partly terminated.
Figure 3:
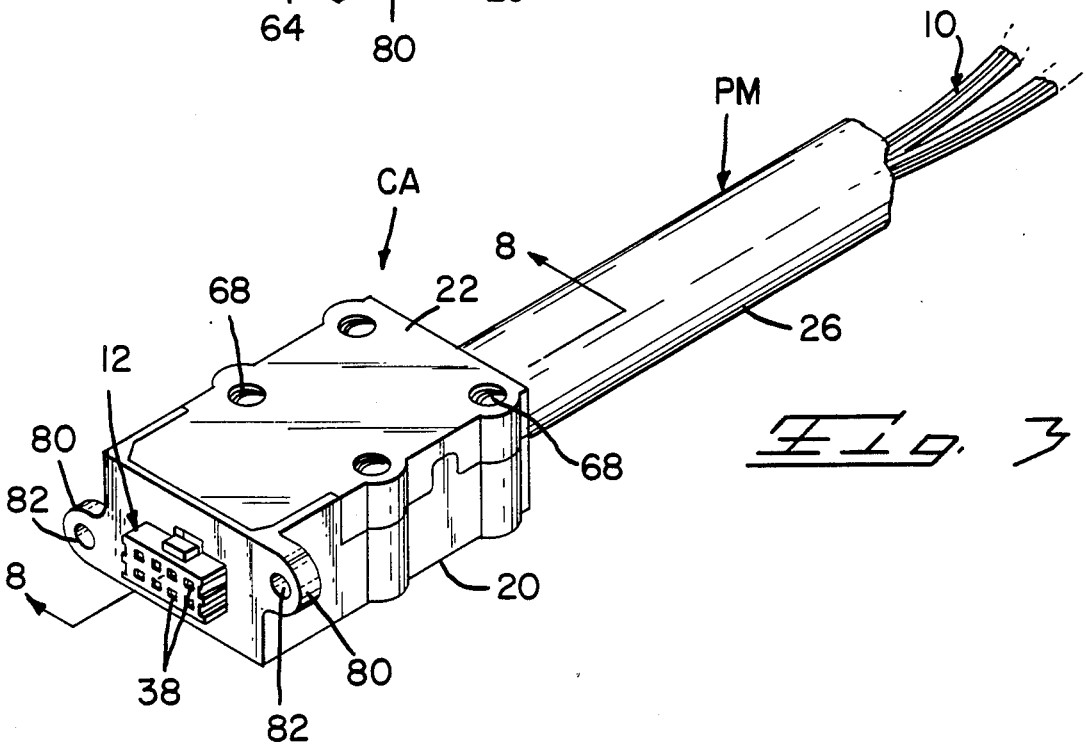
FIG. 3 shows a view similar to FIG. 2 with the cable assembly completely terminated.
Figure 4:
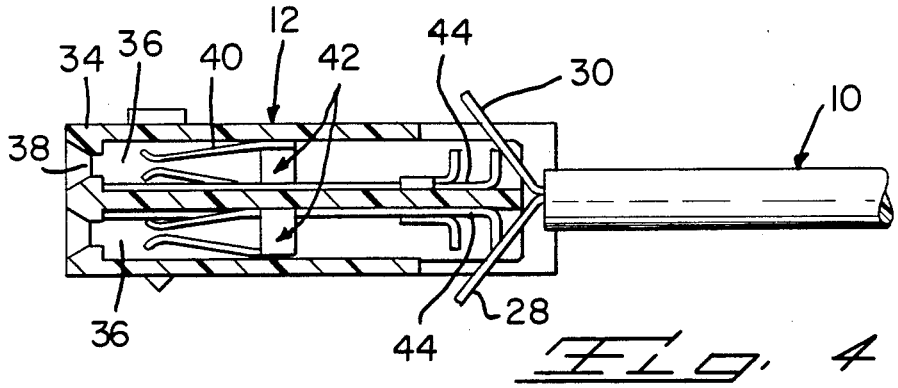
FIGS. 4–7 illustrate the various steps of terminating an end of a ribbon coax cable to an electrical connector.
Figure 5:
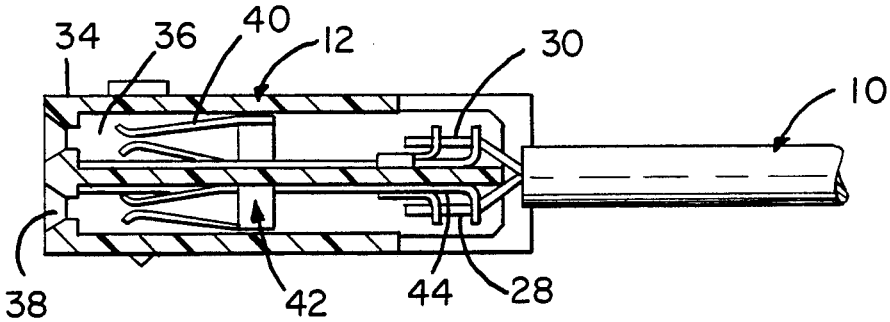

FIGS. 1–3 illustrate the ribbon coax cable assembly CA which includes ribbon coaxial cable 10, electrical connector 12, cover members 14, metal strain member 16, braid 18, clamp body 20, clamp cover 22, bushing 24, and jacket 26. Metal strain member 16 is a flexible tubular member having projections in a spiral orientation with metal braid 18 thereover and dielectric jacket 26 covering the braided-metal strain member 16, 18.

The ribbon coaxial cable 10 is completely disclosed in U.S. Pat. No. 3,775,552 and is incorporated by reference herein. This cable comprises signal conductors 28 disposed in sheaths of insulation along which drain conductors 30 extend with metal foil encircling each dielectric sheathing and drain conductor 30 associated therewith thereby defining coaxial conductor members with a dielectric jacket 32 covering the coaxial conductor members which maintains them insulated from each other. In the present situation, the coaxial conductor members are typically in pairs which have their ends stripped to expose signal conductors 28 and drain conductors 30 as illustrated.

The pairs of coaxial conductor members are disposed in a protective member PM which comprises the metal strain member 16, braid 18 thereover, and jacket 26 of a suitable dielectric material. Bushing 24 of a suitable plastic material is located in the end of protective member PM to protect ribbon coaxial cable 10.

Electrical connector 12 is of a type disclosed in U.S. Pat. No. 4,040,704 which is incorporated by reference herein, but other suitable connectors can, of course, be utilized. Electrical connector 12 includes a dielectric housing 34 molded from a suitable dielectric material. Contact-receiving passageways 36 extend through housing 34 which communicate with beveled openings 38 at the front of housing 34 to enable pins (not shown) of a complementary electrical connector to electrically connect with electrical contact sections 40 of electrical contact members 42 secured in contact-receiving passageways 36. Electrical contact members 42 also include conductor-receiving sections 44 in which signal conductors 28 and drain conductors 30 are respectively electrically connected therein according to conventional electrical terminating practices.

Figure 6:
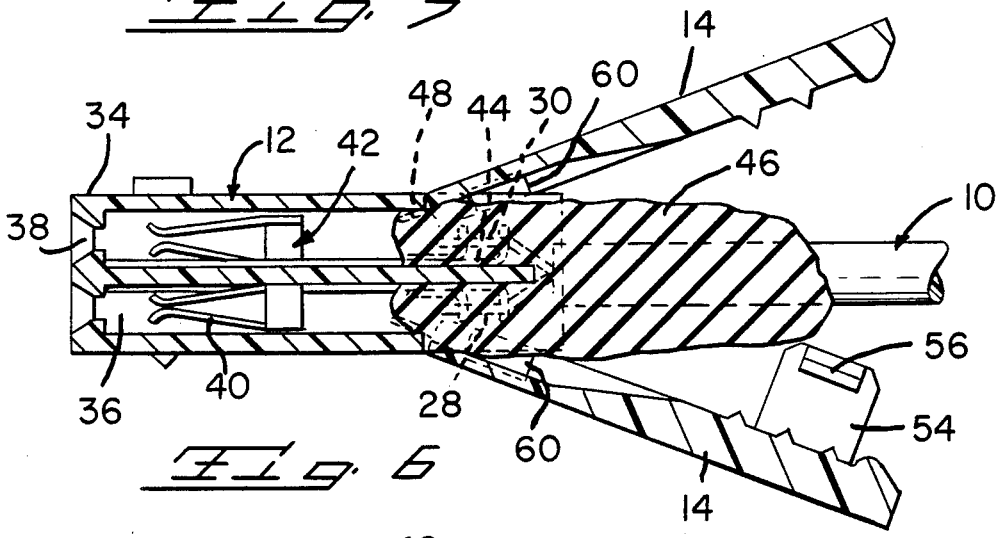

After signal conductors 28 and drain conductor 30 are electrically connected to respective conductor-receiving sections 34 of electrical contact members 42, an elastomeric material 46 is applied onto terminated conductor-receiving sections 44 and a section of ribbon coaxial cable 10 as illustrated in FIG. 6 thereby covering the terminations of signal conductors 28 and drain conductors 30 in their respective conductor-receiving sections 44. Elastomeric material 46 is preferably a Silastic Rubber No. 3110 which uses a Silastic Rubber Catalyst Type S from Dow-Corning. The elastomeric material is in a flowable condition when applied to the terminated ends of signal conductors 28 and drain conductors 30 in conductor-receiving sections 44 and onto the end of ribbon coaxial cable 10 to enable the elastomeric material 46 to be readily applied thereto. The elastomeric in this state also completely surrounds the conductors thereby isolating them from one another.

Cover members 14 include projections 48, inner inclined surfaces 50, spaced projections 52, and latching arms 54 which have lugs 56 thereon for engagement in recesses 58 located in the top surfaces of cover members 14.

In use, projections 48 of cover members 14 are disposed in passageways 36 which retain cover members 14 in connection with housing 34. Cover members 14 are then moved toward each other as illustrated in FIG. 6 whereupon they engage elastomeric material 46 and then cover members 14 are latchably secured together via latching arms 54, lugs 56, and recesses 58. Cover members 14 are also provided with recesses 60 which meet with projections 62 of housing 34.

Figure 7:
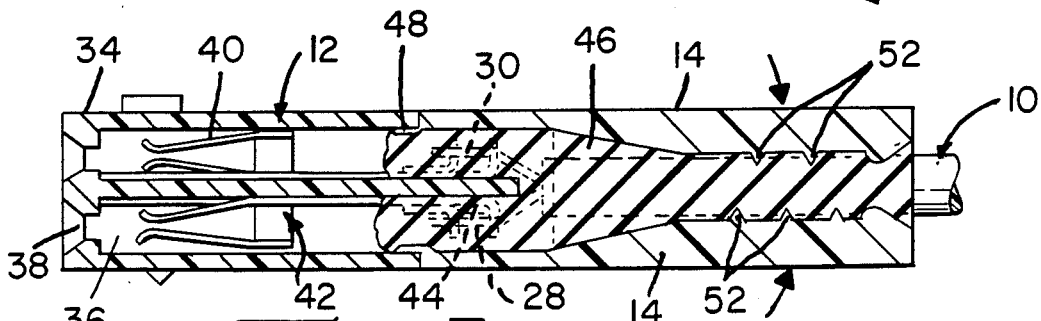

The movement of cover members 14 into engagement with elastomeric material 46 causes elastomeric material 46 to conform to the configuration of cover members 14 thereby molding elastomeric material 46 into a final configuration when cover members 14 are latched together as illustrated in FIG. 7. As a result of this operation, excess elastomeric material 46 is expressed exteriorly of housing member 34 and cover members 14 which is wiped away by a rag or some similar object. Elastomeric material 46 is then subjected to the action of room temperature vulcanizing thereby causing elastomeric material 46 to have a rubber consistency with a durometer of the same as or substantially the same as that of dielectric jacket 32. Thus, any twisting or bending of ribbon coaxial cable 10 will transmit any stresses applied to cable 10 by such bending or twisting action to vulcanized elastomeric material 46 thereby maintaining the integrity of the terminations of the conductors of cable 10 to electrical contact members 42. The bending stresses can occur by bending the cable in the vertical and/or horizontal planes.

Thus, stresses applied to the cable are transmitted to the vulcanized elastomeric material which absorbs such stresses to maintain the stresses in equilibrium and the electrical terminations will not fail or the conductors become shorted.

Terminated ribbon coax cables as hereinabove disclosed can be used to interconnect electronic circuits.

Figure 8:
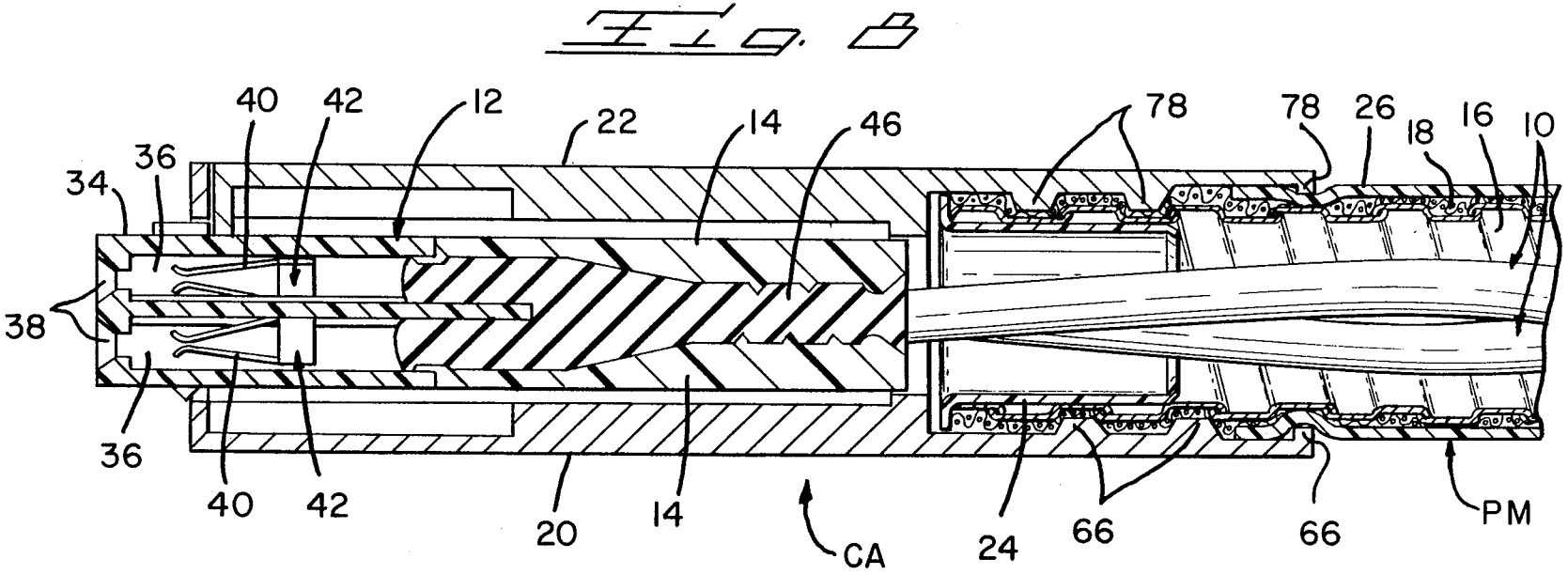
FIG. 8 is a cross-sectional view taken along line 8—8 of FIG. 3.

As shown in FIGS. 1–3 and 8, terminated electrical connector 12 with cover members 14 secured thereto is positioned within a profiled section 64 of clamp body 20 to accommodate electrical connector 12, cover members 14, exposed braided-metal strain member 16, 18 and a section of jacket 26. Internal projections 66 are located in clamp body 20 for engagement with the braided-metal strain member and jacket 26. Clamp cover 22 fits onto clamp body 20 and is secured thereto by screws 68 extending through holes 70 in clamp cover 22 and threadably engaging threaded holes 72 in clamp body 20. Recesses 74 are located in the sides of clamp cover 22 which mate with lugs 76 extending outwardly from clamp body 20. Projections 78 are also located on an inside surface of clamp cover 22 and along with projections 66 of clamp body 20 engage braided-metal strain member 16, 18 and jacket 26 as illustrated in FIG. 8. Clamp body 20 and clamp cover 22 electrically connect with braided-metal strain member 16, 18 via projections 66 and 78 when body 20 and cover 22 are secured together on connector 12, cover members 14, braided metal strain member 16, 18, and jacket 26. Moreover, when body 20 and cover 22 are clamped onto the end of protective member PM, it is deformed from a circular configuration to a modified eliptical configuration which prevents relative rotational movement between body 20, cover 22, and the end of the protective conduit member. Ears 80 with holes 82 therethrough are located on clamp body 20 to secure terminated electrical connector 12 in position onto electronic equipment in electrical engagement with the electrical connector thereof to provide an input-output connection to such electronic equipment.

The use of protective member PM, clamp body 20 and clamp cover 22 provides shielding to cable 10 that enables the terminated cable to comply with FCC requirements that reduces radiation to acceptable levels required by the FCC and to protect the ribbon coax cable therein. Twist and bend stresses applied to this protected cable termination will be absorbed by the elastomeric material to maintain the integrity of the electrical terminations to prevent failure thereof. This protected cable can also take substantial punishment without any damage thereto. The braided-metal strain member 16, 18 also prevents any elongation of the terminated and protected cable.

I claim:

1. A ribbon coax cable assembly, comprising:

a ribbon coax cable including a series of coax cable means covered by a dielectric jacket, each of the coax cable means including a center conductor surrounded by a dielectric sheath on which is disposed an outer conductor with a drain conductor extending along and in electrical engagement with the outer conductor, braid means including insulating jacket means covering the ribbon coax cable, ends of the center and drain conductors being exposed, an end of the braid means being exposed, strain relief means extending along at least the exposed end of said braid means;

electrical connector means including insulating housing means and electrical terminal means, said terminal means having contact section means and conductor-securing section means, said insulating housing means having passageway means in which said contact section means and said conductor-securing section means are secured, said passageway means along which said conductor-securing section means extend being exposed, the exposed ends of the center conductors and drain conductors being terminated in respective conductor-securing section means;

moldable dielectric means disposed in the exposed portions of the passageway means covering the conductor-securing section means, the exposed ends of the center and drain conductors terminated in the conductor-securing section means and an end of the ribbon coax cable;

cover means secured onto said insulating housing means thereby causing said moldable dielectric means to mold into the exposed portions of the passageway means, onto and about the conductor-securing section means and the exposed ends of the center and drain conductors terminated therein and onto the end of the ribbon coax cable, the molded dielectric means curing to a consistency whereby the exposed ends of the conductors are secured in position so that the exposed conductor ends are isolated and will not move so as to short one another and twisting stresses applied to the ribbon coax cable will be absorbed by said molded and cured dielectric means;

clamp body means having profiled section means in which said electrical connector means with said cover means are secured thereon and, said strain relief means, said exposed end of said braid means and an end of said insulating jacket means are disposed;

clamp cover means secured onto said clamp body means covering said electrical connector means with said cover means secured thereon as well as, said strain relief metal means, said exposed end of said braid means and the end of said insulating jacket means; and means on said clamp body means and said clamp cover means clamping the exposed end of said braid means into engagement with said strain relief means thereunder.

2. A ribbon coax cable assembly as set forth in claim 1, wherein said clamping means also clampingly engages the insulating jacket means

3. A ribbon coax cable assembly as set forth in claim 1, wherein said clamp body means and said clamp cover means are metal.

4. A ribbon coax cable assembly as set forth in claim 1, wherein said strain relief means extends along the length of the braid means and onto which the braid means is disposed.

5. A ribbon coax cable assembly as set forth in claim 1, wherein said moldable dielectric means comprises a vulcanizable elastomeric material.

6. A ribbon coax cable assembly as set forth in claim 5, wherein the elastomeric material in its cured condition has a durometer substantially the same as that of said insulating jacket means.

7. A ribbon coaxial cable assembly comprising an electrical connector and a ribbon coaxial cable comprised of elongated and conductive drain conductors, elongated and conductive center conductors, each center conductor being surrounded concentrically by a separate corresponding dielectric sheathing means, each dielectric sheathing means and a corresponding drain conductor being mutually engaged along their corresponding lengths and together encircled by a separate corresponding conductive outer conductor means, and a dielectric jacket covering and separating the outer conductor means one from the other.

the electrical connector further comprising and insulative housing, passageways in the housing, conductive electrical terminals in and along respective passageways, said terminals having respective contact sections and respective conductor-securing sections electrically connected to respective center conductors or respective drain conductors, the improvement comprising:

said housing having a portion supporting said conductor securing sections and an opening exposing said conductor securing sections and the respective center conductors and respective drain conductors secured to said conductor securing sections, said respective center conductors and said respective drain conductors having conductive projecting portions that project outwardly from said conductor securing portions and outwardly of said passageways and into a remainder of said cable, a space between said remainder of said cable and said portion of said housing supporting said conductor securing sections, said conductive projecitng portions projecting through said space, moldable dielectric material having applied in said space to flow and surround individually each of said conductive projecting portions of said respective drain conductors and said respective center conductors and to isolate them one from the other, and dielectric cover means circumferentially surrounding the dielectric material and with the dielectric material filling said space, and said cover means having molded the circumferential exterior of the dielectric material in conformity with the interior of said cover means, said cover means being secured to said housing and surrounding said space and surrounding and engaging a portion of said remainder of said cable.

8. A coaxial cable assembly as set forth in claim 7, wherein the improvement further comprises: said cover means includes latching means for removably securing and latching said cover means to said housing.

9. A coaxial cable assembly as set forth in claim 7, wherein the improvement further comprises: a bipartite metal shell removably enclosed over said housing and said cover means and said portion of said cable.

10. A coaxial cable assembly as set forth in claim 7, wherein the improvement further comprises: said cover means covers said opening of said housing.

11. A coaxial cable assembly as set forth in claim 10, wherein the improvement further comprises: said dielectric material extends into said housing and surrounds said conductor securing sections and projects through said opening of said housing to engage said cover means.

* * * * *